US006862750B1

(12) United States Patent
Rasberry

(10) Patent No.: US 6,862,750 B1
(45) Date of Patent: Mar. 8, 2005

(54) SOFT STRAP HELMET STABILIZER

(75) Inventor: Don Rasberry, 1910 Riverside, Bullhead City, AZ (US) 86442

(73) Assignee: Don Rasberry, Bullhead City, AZ (US)

( * ) Notice: Subject to any disclaimer, the term of this patent is extended or adjusted under 35 U.S.C. 154(b) by 0 days.

(21) Appl. No.: 10/785,468

(22) Filed: Feb. 23, 2004

(51) Int. Cl.[7] ..... A42B 1/24; A42B 7/00
(52) U.S. Cl. ..... 2/422; 2/421; 2/424
(58) Field of Search ..... 2/421, 425, 422, 2/424

(56) References Cited

U.S. PATENT DOCUMENTS

| | | | | | |
|---|---|---|---|---|---|
| 2,908,911 | A | * | 10/1959 | Sowle | 2/9 |
| 4,062,068 | A | * | 12/1977 | Davenport et al. | 2/421 |
| 4,215,437 | A | * | 8/1980 | Kao | 2/424 |
| 4,290,150 | A | * | 9/1981 | Guerre-Berthelot | 2/421 |
| 4,538,303 | A | * | 9/1985 | Schnitzler | 2/424 |
| 4,581,774 | A | * | 4/1986 | Chaise | 2/421 |
| 4,612,672 | A | * | 9/1986 | Schrack | 2/68 |
| 4,796,309 | A | * | 1/1989 | Nava | 2/414 |
| 5,095,550 | A | * | 3/1992 | Perlinger | 2/422 |
| 5,412,810 | A | * | 5/1995 | Taniuchi | 2/424 |
| 5,765,229 | A | * | 6/1998 | McLeod et al. | 2/195.1 |
| 6,289,521 | B1 | * | 9/2001 | Ikeda | 2/421 |

FOREIGN PATENT DOCUMENTS

| | | | | |
|---|---|---|---|---|
| DE | 3419302 A1 | * | 11/1985 | A42B/3/02 |
| EP | 259269 A1 | * | 3/1988 | A42B/3/00 |

* cited by examiner

*Primary Examiner*—Rodney M. Lindsey

(57) ABSTRACT

The invention is a chin stabilizer system for a full-face helmet, such as a motorcycle helmet or the like. It includes a flexible material having a generally triangular configuration with snap fittings at each point of the triangle. The snap fittings connect the flexible material to the helmet, underneath the chin. One snap fitting connects the material near the chin, while the other two connect the material to the helmet on opposite sides, near the wearer's jaw. The flexible material restrains the helmet from riding up over the face of the wearer.

4 Claims, 3 Drawing Sheets

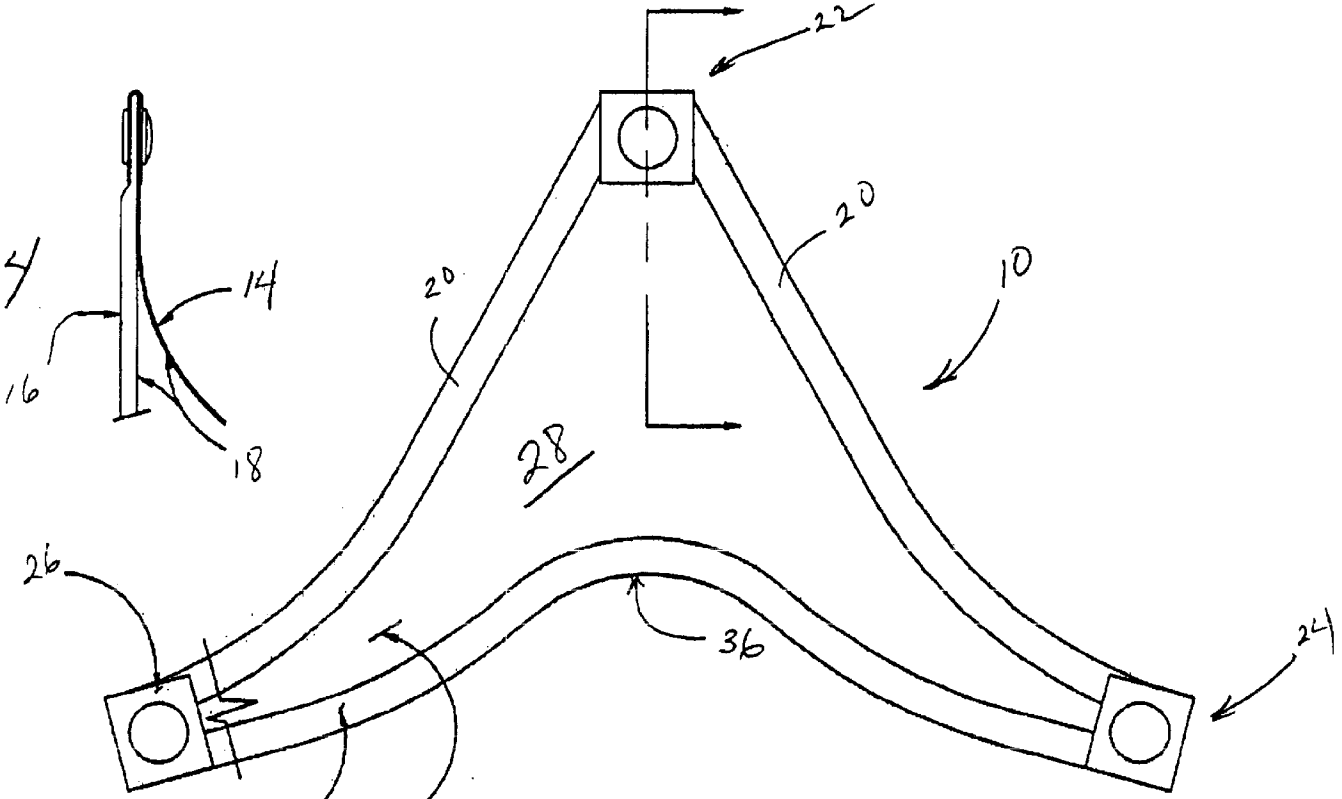
Fig. 2
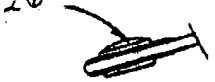
Fig. 3
Fig. 4

SOFT STRAP HELMET STABILIZER

TECHNICAL FIELD

The present invention relates to all full-face helmets of the type that are used in motocross, off-road racing, BMX, snowcross, auto racing, boat racers and jet skiers, on land and water. More particularly, the invention relates to a stabilizer system that supplements a conventional helmet chin strap.

BACKGROUND OF THE INVENTION

Full-face helmets are, of course, well-known in the art. These helmets typically have a single, integrated shell that is padded, with a forward portion that covers the wearer's mouth and chin area. An elliptically-shaped opening curves around the front so that the wearer can see. The helmet is held on the wearer's head by a chin strap that extends underneath the wearer's jaw near his or her throat. Chin straps typically consist of two strips of material, one each being connected to opposite sides of the helmet. The two pieces are joined together by a double-ring buckle. Typically, the chin strap is in the neighborhood of about one-inch in width.

Full-face helmets are worn for a variety of reasons relating to both safety and speed. They also help keep out the cold. When used for off-road or motocross racing they help keep debris off the face and chin.

Conventional helmet chin straps create a pivot-point that allows a helmet to ride up and down on the wearer's head. For example, even if the helmet fits correctly, conventional chin straps will allow the front part of a full-face helmet to move up and down approximately four inches relative to the wearer's face. This is a problem and has been for years. It becomes particularly problematical for off-road racing, motocross, ATV, snowmobiles, BMX, jet skiers, boat racers, and ECT uses, where the rider or driver of the vehicle is subject to a variety of forces that can move the helmet relative to the head. These uses can create a potentially dangerous situation when a full-face helmet "rides" far enough up the face while the vehicle is moving, such that the portion that covers the mouth begins to block the wearer's view.

The present invention solves the above problem by providing a stabilizer system that impedes the ability of the helmet to ride upwardly in the manner just described.

SUMMARY OF THE INVENTION

The invention is a stabilizer system for use in connection with all full-face helmets. The invention includes a separate snap fitting that is mounted or positioned at three locations on the helmet. One snap fitting is mounted forwardly, near the helmet's lower edge, in or near the chin region. Another pair of snap fittings are mounted near the helmet's edge, on opposite sides of the helmet, near the jaw region of the helmet.

The invention includes a chin stabilizer made of a durable, flexible material. The chin stabilizer has a generally triangular configuration, with a forward vertex that is connected to the snap fitting on the chin of the helmet and lateral portions that are connected, one each, to the second and third snap fittings on opposite sides. A central portion of the chin stabilizer rests underneath the wearer's chin when the stabilizer is connected.

In use, the helmet is placed over the wearer's head, the chin strap is buckled, and the chin stabilizer is then snapped into place. Preferably, the snap fittings on the side are positioned sufficiently aft, relative to the jaw, so that the chin stabilizer fits snugly against the underside of the chin. This resists any upward force that is asserted against the front of the helmet.

The chin stabilizer is preferably made of vinyl or other materials having similar durability. It may be padded on one side for comfort. Moreover, the portion of the stabilizer that is adjacent the throat has a concave curve so that it generally follows the shape of the wearer's neck.

The invention as described above will become better understood upon review of the following description, which is to be taken in conjunction with the drawings.

BRIEF DESCRIPTION OF THE DRAWINGS

In the drawings, like reference numerals and letters refer to like parts throughout the various views, and wherein:

FIG. 2 is a top view of the chin stabilizer shown in FIG. 1;

FIG. 3 is a side view of a snap fitting on the stabilizer shown in FIG. 2;

FIG. 4 is a view like FIG. 3, but shows a backing material peeled away from the stabilizer.

BEST MODE FOR CARRYING OUT THE INVENTION

Figure 1:
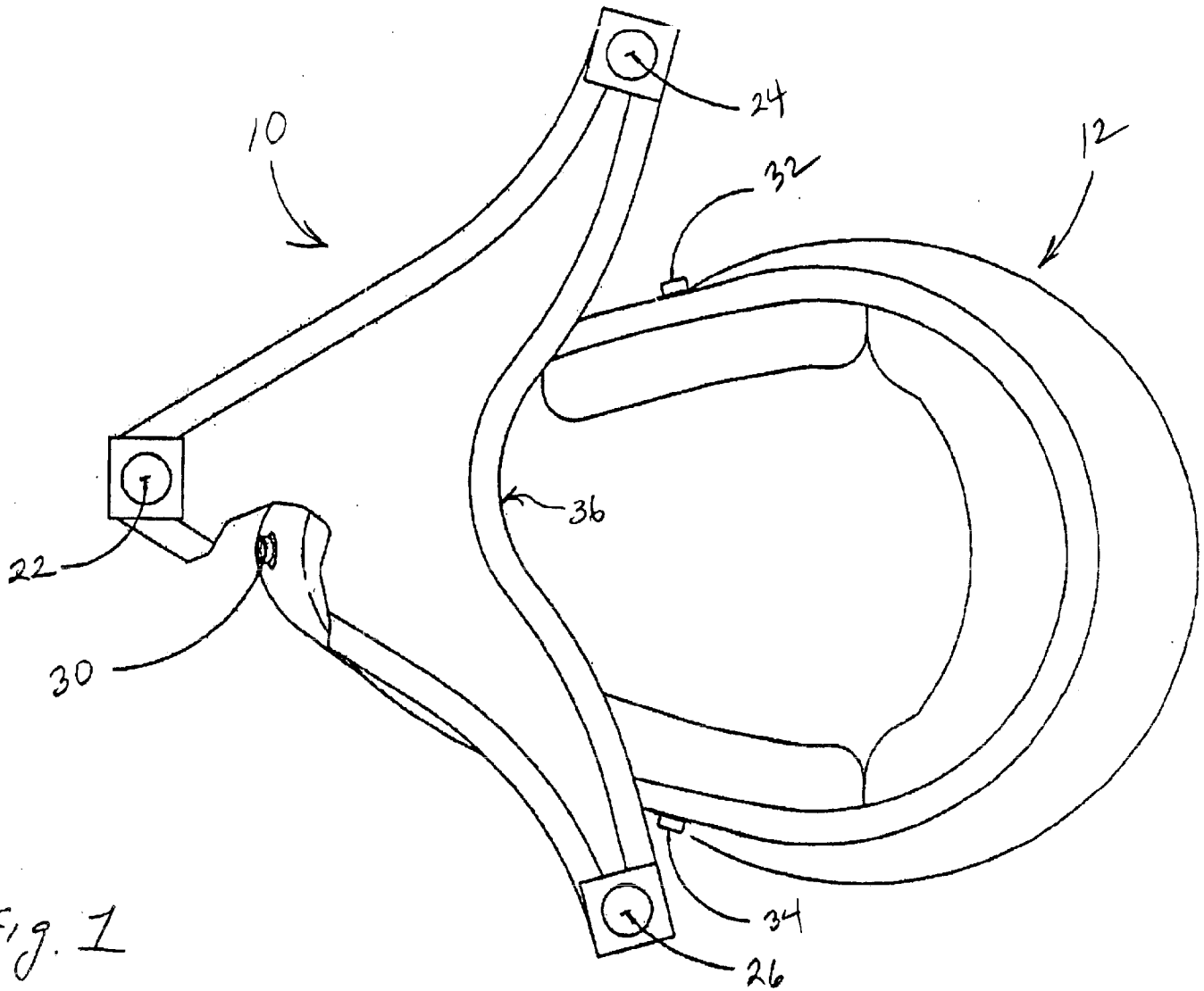
FIG. 1 is a pictorial view of the bottom of a full-face helmet with a chin stabilizer constructed in accordance with the invention, the chin stabilizer being exploded below the helmet, and a partial section of the chin stabilizer being cut away to reveal a snap fitting in the chin region of the helmet.
Figure 5:
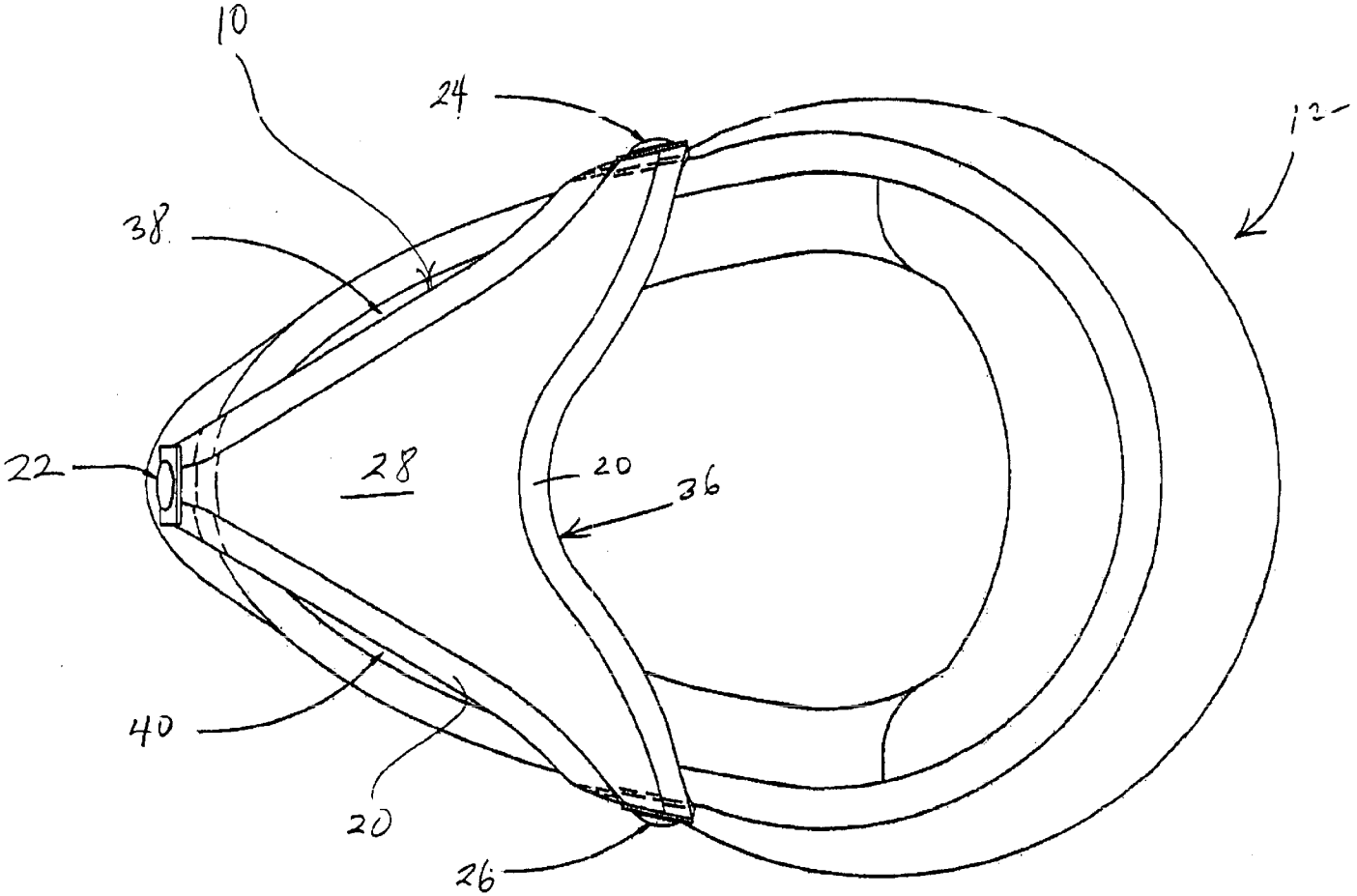
FIG. 5 is a view like FIG. 1, but shows the chin stabilizer mounted to the helmet.

Referring now to the drawings, and first to FIG. 1, shown generally at 10 is a chin stabilizer constructed in accordance with a preferred embodiment of the invention. The chin stabilizer 10 has a generally triangular configuration and is connected to the bottom of a full-face motorcycle helmet 12, in the manner shown in FIG. 5.

Referring now to FIG. 2, the chin stabilizer 10 is made of a flexible but durable material. In preferred form, it is multi-layered and has a vinyl, or vinyl-equivalent, layer 14 on the outside, a cloth layer 16 on the inside, and a layer of thin foam padding 18 sandwiched between the outer and inner layers (see FIG. 4). The outer and inner layers 14, 16 are sewn together to create the peripheral band shown at 20 in FIG. 2.

The chin stabilizer 10 has three "female" snap fittings 22, 24, 26. Each one of the snap fittings 22, 24, 26 is attached to the chin stabilizer 10 via conventional means. The central portion 28 of the chin stabilizer 10, which is padded, rests underneath a wearer's chin when the stabilizer is connected to the helmet 12. Referring to FIG. 1, the helmet has three corresponding "male" snap fittings 30, 32, 34. In use, the snap fitting 22 on the vertex of the stabilizer is connected to the snap fitting 30 on the helmet. Snap fitting 30 is on the forward, chin region of the helmet near the lower edge of the helmet. Similarly, female snap fittings 24, 26 are connected to male fittings 32, 34, which are on opposite sides of the helmet, near the jaw region of the wearer. The second and third male snap fittings 32, 34 are positioned sufficiently aft of the chin, and upward from the lower edge of the helmet, such that the chin stabilizer 10 is pulled snugly against the helmet. The chin stabilizer 10 has a concave curve 36 that follows the shape of the wearer's neck.

The stabilizer system described above is easy to adapt to any conventional full-face helmet in use today. It is very easy to place male snap fittings on a helmet with a simple kit. The snap fittings 22, 24, 26 on the chin stabilizer 10 are of conventional size and shape. In use, the wearer places the helmet on his or her head, buckles the chin strap (not shown in the drawings), and attaches the chin stabilizer in the manner shown in FIG. 5. The generally triangular shape of the chin stabilizer creates air vents 38, 40 for the wearer (see FIG. 5). It also constrains the forward face of the helmet from being pushed upwardly over the wearer's chin and nose.

It is to be appreciated that the chin stabilizer 10 and related snap-fittings system could be modified in many different ways without departing from what is considered to be the invention. It is obvious that many different kinds of materials could be used to make the chin stabilizer. There may be many different ways of making a "cushioned" or "padded" stabilizer. For example, neoprene rubber may be suitable for use in making the stabilizer 10 for water sports. While it is believed that snap fittings are the best way to mount the stabilizer 10 to a helmet 12, it is conceivable that other ways may be devised that perform the same function, in substantially the same way, to produce substantially the same result. While the chin stabilizer was designed for full-face helmets, it is possible that it could be used on other kinds of helmets, like football or baseball helmets. Therefore, what is considered to be the invention is not to be limited by the foregoing description. Instead, the invention is to be limited only by the patent claim or claims which follow, the interpretation of which is to be made in accordance with the established doctrines of patent claim interpretation.

What is claimed is:

1. A stabilizer system for a full-face motorcycle helmet, comprising:

a separate snap fitting for being positioned at three locations on the helmet, one forwardly near the chin region, and a second and third on opposite sides near the jaw region of the helmet;

a chin stabilizer made of a flexible material, the chin stabilizer material having a generally triangular configuration that is stretched underneath the chin and jaw region of the helmet when the helmet is on a wearer's head, with a vertex that is connectable to and overlaps the snap fitting near the chin region of the helmet and lateral portions that are connectable, one each, to and overlapping the second and third snap fittings on opposite sides of the helmet, and further, the chin stabilizer having a central portion that rests underneath a wearer's chin and jaw when the stabilizer is connected to the helmet, the central portion substantially covering the region below the wearer's chin and jaw from the wearer's chin to throat, and thereby substantially covering the open area of a full-face helmet that normally exists between the wearer's throat and the lower forward edge of the helmet, for impeding upward movement of the front of the helmet over the face of the wearer.

2. The stabilizer system of claim 1, wherein the chin stabilizer has a curved portion adjacent to the wearer's throat that is curved for following the shape of the wearer's neck.

3. The stabilizer system of claim 1, wherein the chin stabilizer comprises an outer layer of material, an inner layer of material, and a layer of padding sandwiched between the outer and inner layers.

4. The stabilizer system of claim 1, wherein the chin stabilizer comprises neoprene rubber.

* * * * *